US006602098B2

(12) United States Patent
Sugie et al.

(10) Patent No.: US 6,602,098 B2
(45) Date of Patent: Aug. 5, 2003

(54) CONNECTOR WITH RETAINER

(75) Inventors: Naoto Sugie, Shizuoka-ken (JP); Toshinori Yamamoto, Shizuoka-ken (JP); Seiji Kozono, Shizuoka-ken (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 09/905,109

(22) Filed: Jul. 16, 2001

(65) Prior Publication Data

US 2002/0028609 A1 Mar. 7, 2002

(30) Foreign Application Priority Data

Jul. 17, 2000 (JP) ..... 2000-216519
Jul. 11, 2001 (JP) ..... 2001-210784

(51) Int. Cl.[7] ..... H01R 13/514
(52) U.S. Cl. ..... 439/752; 439/681
(58) Field of Search ..... 439/752, 880, 439/595, 488, 271, 283, 681

(56) References Cited

U.S. PATENT DOCUMENTS 4,636,024 A * 1/1987 Yahata ..... 439/488
5,167,534 A * 12/1992 Ohsumi ..... 439/752
5,468,162 A * 11/1995 Oda ..... 439/752
5,554,052 A * 9/1996 Saijo et al. ..... 439/595
5,941,737 A * 8/1999 Sakai et al. ..... 439/595
6,264,497 B1 * 7/2001 Murakami et al. ..... 439/752
6,290,521 B1 * 9/2001 Suzuki et al. ..... 439/595
6,358,102 B1 * 3/2002 Fukamachi ..... 439/752
6,361,378 B1 * 3/2002 Konoya et al. ..... 439/752

FOREIGN PATENT DOCUMENTS

| | | |
|---|---|---|
| EP | 0214794 | 3/1987 |
| EP | 0540008 A1 | 5/1993 |
| EP | 0678938 A1 | 10/1995 |
| JP | 01-177875 | 12/1989 |
| JP | 2-4994 | 1/1990 |
| JP | 06-310199 | 11/1994 |
| JP | 07-094229 | 4/1995 |
| JP | 09-082396 | 3/1997 |
| JP | 11-097096 | 4/1999 |
| JP | 11-097097 | 4/1999 |
| WO | WO/98/24150 | 6/1998 |

* cited by examiner

*Primary Examiner*—Gary Paumen
*Assistant Examiner*—Felix O. Figueroa
(74) *Attorney, Agent, or Firm*—Finnegan, Henderson, Farabow, Garrett, & Dunner, L.L.P.

(57) ABSTRACT

A connector housing has an abutment surface with which a front end surface of an opposing connector is brought into contact at a time of fitting to the opposing connector. Terminal metal fittings are inserted to positions rearward from the abutment surface from terminal insertion holes in the connector housing. A retainer is moved to a regular engagement position from a temporary engagement position so as to prevent the terminal metal fittings from falling off rearward, and is provided with a projection extending forward from the abutment surface of the connector housing.

10 Claims, 15 Drawing Sheets

CONNECTOR WITH RETAINER

BACKGROUND OF THE INVENTION

1. Field of the Invention

The present invention relates to a connector with a retainer engaging with terminal metal fittings inserted to a connector housing so as to prevent the terminal metal fittings from falling off.

2. Description of the Related Art

This kind of connector with a retainer has been known as a technique described in Japanese Patent Application Laid-open No. 11-97097. The connector is provided with an outer housing and an inner housing fitted to each other, and is assembled by engaging terminal metal fittings so as to prevent it from falling off, by inserting the terminal metal fittings to terminal insertion holes in the inner housing, inserting a retainer (also called a side spacer) to a retainer insertion hole provided in a side portion of the inner housing and operating so as to move the retainer from a temporary engagement position to a main engagement position, and inserting and fixing the inner housing to the outer housing from the rear portion in the state mentioned above.

In this connector, when the retainer is at the temporary engagement position, a part of the retainer protrudes outward from the retainer insertion hole, thereby preventing the inner housing from being fitted to the outer housing. Accordingly, the structure is made such that the inner housing can be inserted into the outer housing only in a state that the retainer is moved to the regular engagement position, whereby it is possible to prevent the retainer from failing to be moved to the regular engagement position. Further, the structure is such that the retainer is not visible from the external portion by concealing the retainer insertion hole inside the outer housing.

SUMMARY OF THE INVENTION

In the connector mentioned above, it is not intended to move the retainer in a state of assembling the inner housing in the outer housing, so that it is impossible to cancel the state of engagement of the retainer according to some operation in a state of assembling the inner housing in the outer housing. In the case of forcibly performing such an operation, there can be considered to employ a method of inserting a jig into a hood so as to reach the retainer, however, since the retainer itself is arranged so as to hide backward in the terminal metal fittings, it is hard to simply move the jig to the temporary engagement position even if the jig can be inserted from the front side.

The present invention has been made with such points in view. An object of the present invention is to provide a connector with a retainer in which the retainer can be moved by a jig inserted from the hood side in a state of maintaining an assembling state of a connector housing.

A first aspect of the present invention provides a connector comprising: a connector housing having an abutment surface with which the front end surface of an opposing connector is brought into contact when being fitted to the opposing connector, at an inner back portion of the hood fitted to the opposing connector; terminal metal fittings which are inserted into terminal insertion holes in the connector housing from the rear portion; a retainer inserted in the inner portion of the connector housing at a rear position from the abutment surface and moved to a regular engagement position from a temporary engagement position so as to prevent the terminal metal fittings from falling off rearward: and a projection extending forward from the abutment surface of the connector housing, the projection being provided in the retainer.

In this connector, it is possible to move the retainer inserted in the inner portion of the connector housing from the regular engagement position to the temporary engagement position by moving the projection using the front end of the jig inserted into the inner portion of the hood in the connector housing. Accordingly, it is possible to cancel the regular engagement of the retainer without completely canceling the assembled state of the connector, and it is possible to take out an optional terminal metal fitting. In this case, since the projection protrudes forward from the abutment surface with the opposing connector, a short jig is possible, and the retainer is easily moved.

Further, since the retainer can be moved between the temporary engagement position and the regular engagement position while substantially maintaining the assembled state or in a state that a substantial assembly is completed, it is possible that assembly is completed without the regular engagement of the retainer, in contrast to the cited art in which completion of assembly preceded by regular engagement of the retainer. However, in the connector according to the present invention, since the projection is at a position easily visible by taking a look inside the hood, it is possible to easily view whether the retainer is at a temporary or regular engagement position according to the position of the projection. Accordingly, it is possible to prevent the terminal from falling off due to a regular engagement miss, and it is possible to secure a stable conductive performance.

A second aspect of the present invention provides a connector with a retainer according to the first aspect, wherein the connector housing comprises an outer housing and an inner housing inserted into the inner portion of the outer housing, the retainer is inserted into a retainer insertion hole formed in the inner housing, and the retainer insertion hole is concealed within the outer housing.

This connector comprises the inner housing assembled in the inner portion of the outer housing. When the inner housing is assembled in the inner portion of the outer housing, the retainer insertion hole is concealed from external view. Accordingly, in the case of this type of connector, once the outer housing and the inner housing are assembled, it is impossible to move the retainer through the retainer insertion hole later. Further, since the retainer is arranged at a position concealed in the rear of the terminal metal fittings, it is normally hard to move the retainer even when inserting the jig from the hood side.

However, in the connector according to the present invention, a projection protruding from the abutment surface of the connector housing is provided to the retainer. Accordingly, it is possible to move the retainer from the regular engagement position to the temporary engagement position by moving the projection using the jig inserted from the hood side. That is, it is possible to cancel the regular engagement of the retainer only by inserting the jig to the inner portion of the hood so that the state of assembly between the outer housing and the inner housing is not cancelled. Further, since the retainer insertion hole is concealed by the outer housing, there is an advantage in that the outer appearance is improved.

A third aspect of the present invention provides a connector with a retainer according to the first aspect, wherein the retainer is a side spacer inserted to the connector housing from a direction opposite to the insertion direction of the terminal metal fittings so as to prevent the terminal metal fittings from falling off, and the side spacer is provided with opening portions allowing the terminal metal fittings to pass when the side spacer is in a temporary engagement position and an engaging wall portion preventing the terminal metal fittings from displacing backward when the side spacer is in the regular engagement position.

In this connector, the side spacer corresponding to the retainer is inserted in a direction opposite to the insertion direction of the terminal metal fittings, and the engaging wall portion of the side spacer receives the terminal metal fittings so as to directly prevent the terminal metal fittings from falling off when the side spacer is in the regular engagement position while the terminal metal fittings can be freely inserted and taken out when the side spacer is at the temporary engagement position. Accordingly, since the retainer directly receives the terminal metal fittings so as to prevent the terminal metal fittings from falling off, it is possible to prevent the terminal metal fittings from falling off by a strong holding force.

Further, the direction parallel to the insertion direction of the terminal becomes the fitting direction of the opposing connector. However, since this direction and the moving direction of the side spacer have an opposite relationship, the side spacer does not move according to the fitting motion of the opposing connector, for example, the side spacer in the temporary engagement position does not erroneously move to the regular engagement position.

According to a fourth aspect of the present invention, there is provided a connector with a retainer according to the first aspect, wherein the projection is interfered with the opposing connector to be fitted so as to prevent the opposing connector from being fitted to a normal position when the retainer is in the temporary engagement position, and the projection allows the opposing connector to be fitted to a normal position when the retainer is at the regular engagement position.

In this connector, when the retainer is at the temporary engagement position, the opposing connector is interfered with the projection and can not be fitted to the normal position. Accordingly, the opposing connector can not be fitted to the normal position, whereby it is possible to detect a regular engagement miss of the retainer and it is possible to prevent the terminal from falling off due to a regular engagement miss, so that it is possible to secure a stable conductive performance.

According to a fifth aspect of the present invention, there is provided a connector with a retainer according to the first aspect, a seal surface which a seal member sealing with respect to the opposing connector is adhered to and brought into contact with is provided in an opening side of an inner wall of the hood in such a manner as to be shifted from an inner wall surface of the hood.

In this connector, since the front end portion of the jig inserted into the inner portion of the hood is guided to the back portion of the hood along the inner wall of the hood, the front end portion of the jig is not in contact with the seal surface provided in such a manner as to be shifted from the inner wall surface of the hood, and it is possible to prevent the seal surface from being broken and the seal performance from being reduced.

According to a sixth aspect of the present invention, there is provided a connector with a retainer according to the fifth aspect, wherein the seal surface is provided outside the inner wall surface of the hood, and a step portion is provided between the seal surface and the inner wall surface of the hood.

In this connector, the front end portion of the jig inserted in the inner portion of the hood is not in contact with the seal surface by being inserted to the back portion of the hood from the step portion. Accordingly, it is possible to prevent the seal surface from being broken, the seal performance from being reduced and to obtain a stable waterproof performance.

According to a seventh aspect of the present invention, there is provided a connector with a retainer according to the first aspect, wherein said connector housing comprises guiding ribs on its inner walls which guide jigs to move said retainer.

In this connector, the jig is guided through the guiding rib to be inserted to an accurate position.

According to an eighth aspect of the present invention, there is provided a connector with a retainer according to the seventh aspect, wherein said connector housing further comprises side walls on either side of said ribs and said side walls are colored in contrast with the color of said guiding ribs.

In this connector, the guiding ribs are easily distinguished by color from the other portion, so that accurate jig insertion is made easier.

According to a ninth aspect of the present invention, there is provided a connector with a retainer according to the first aspect, wherein said connector housing further comprises lances engaging said terminal metal fittings and insertion holes having tapered inner walls through which a jig is inserted to cancel the engagement.

In this connector, when the jig used for canceling the engagement abuts the inner wall of the insertion hole, the jig is guided by tapered inner wall to be inserted into the insertion hole.

According to a tenth aspect of the present invention, there is provided a connector with a retainer according to the first aspect, wherein said connector housing further comprises lances engaged with said terminal metal fittings and insertion holes in which a jig is inserted to cancel the engagement, and a protrusion in which said insertion holes are provided projects from said abutment surface.

In this connector, an entrance of the insertion hole is located nearer to an aperture of the outer housing than the case of the former aspect.

DETAILED DESCRIPTION OF THE PREFERRED EMBODIMENT

Figure 1A:
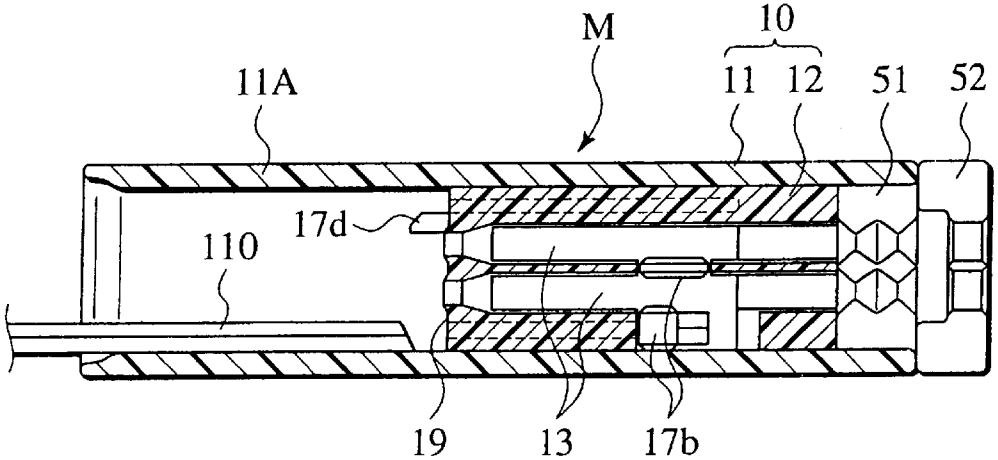
FIG. 1A is a plan cross sectional view of a structure of a connector according to a first embodiment of the present invention.

A description will be given below of a first embodiment according to the present invention with reference to the accompanying drawings.

A connector housing 10 of a connector M is constituted by inserting an inner housing 12 into a cylindrical outer housing 11 and is structured such that the inner housing 12 is inserted and fixed to the rear portion of the outer housing 11, whereby the front portion of the outer housing 11 forms a hood 11A for fitting an opposing connector while guiding.

Terminal insertion holes 13 extending through the inner housing 12 in a longitudinal direction are formed in the inner housing 12, and the structure is made such that a male type terminal metal fittings 20 are inserted into each of terminal insertion holes 13 from the rear portion. Flexible lances 14 primarily engaging the inserted terminal metal fittings 20 are provided in the inner portions of the terminal insertion holes 13.

Further, a retainer insertion hole 16 is formed in the inner housing 12 so as to pass through in a direction perpendicular to the insertion direction of the terminal metal fittings 20. The retainer insertion hole 16 is formed in the lower side of the terminal insertion hole 13 as a thin plate-like space, and a retainer 17 secondarily engaging the terminal metal fittings 20 from a side portion for preventing the terminal metal fittings 20 from falling off is inserted into the retainer insertion hole 16. As mentioned above, since the retainer 17 is inserted from a side direction rather than a front direct ion of the inner housing 12, the retainer 17 is also called as a side spacer.

The retainer 17 has a size capable of being inserted into the retainer insertion hole 16 and is formed in a shape in which a plurality of engaging projections (engaging wall portions) 17*b* protrude from an upper surface of a base plate 17*a* having a rectangular shape in plan view. Intervals between the engaging projections 17*b* are set to be the same as arrangement pitches of the terminal metal fittings 20, and portions between the engaging projections 17*b* and 17*b* are left open as opening portions 17*c*.

Figure 1B:
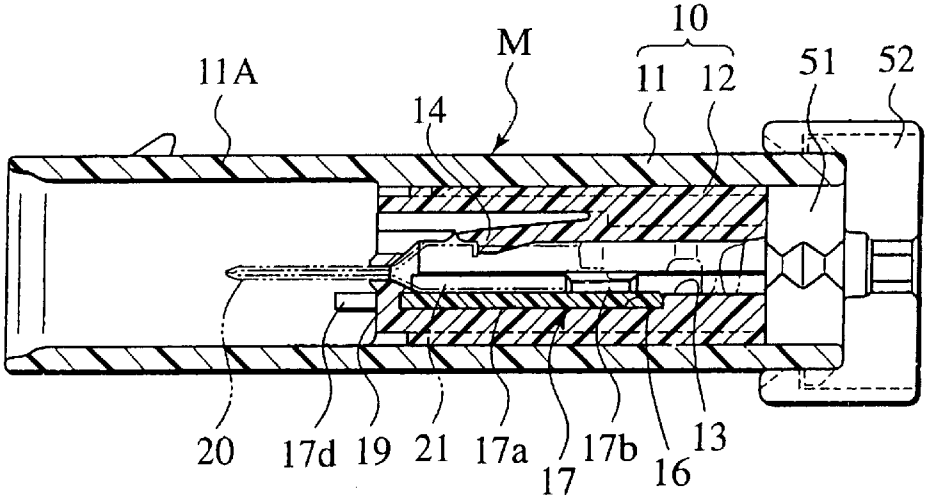
FIG. 1B is a side cross sectional view of a structure of a connector according to the embodiment.
Figure 1C:
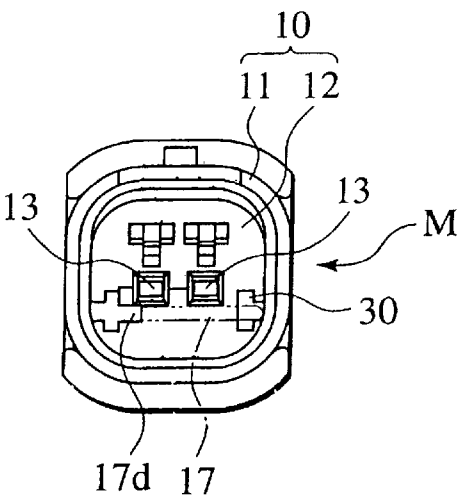
FIG. 1C is a front elevational view of a structure of a connector according to the embodiment.

Further, when the retainer 17 is at the temporary engagement position shown in FIG. 1A, the engaging projections 17*b* are removed from insertion paths of the terminal metal fittings 20 and the opening portions 17*c* are positioned in the insertion paths, thereby allowing the terminal metal fittings 20 to pass through. When the retainer 17 is in the main engagement position, the engaging projections 17*b* enter the rear side of the box portions 21 in the terminal metal fittings 20 and the box portions 21 are received by the engaging projections 17*b*, whereby the terminal metal fittings 20 can be prevented from falling off rearward. In this case, this relationship as viewed from a side surface between the box portions 21 and the engaging projections 17*b* is shown in FIG. 1B.

Figure 3A:
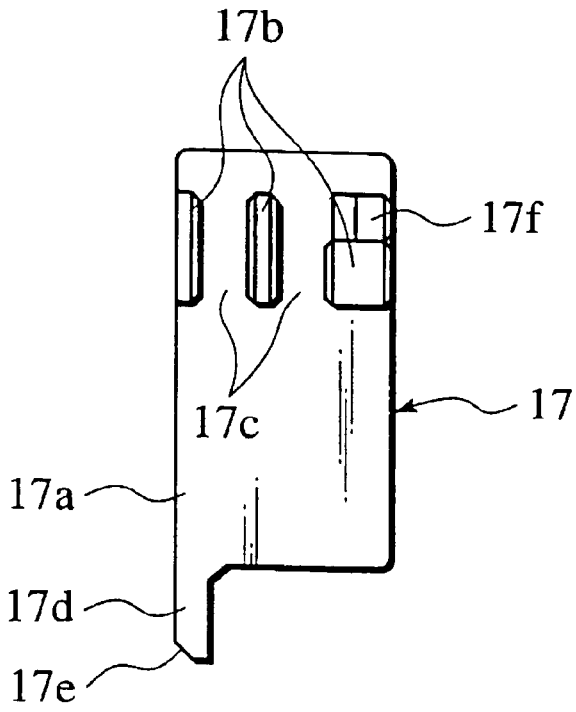
FIG. 3A is a plan view of a retainer in the connector according to the embodiment.
Figure 3B:
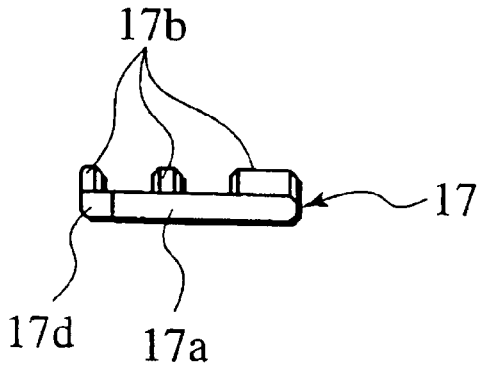
FIG. 3B is a front elevational view of the retainer in the connector according to the embodiment.

Further, as shown in FIG. 3A, a rectangular projection 17*d* for canceling the regular engagement of the retainer 17 is provided on one side end portion of the front end of the base plate 17*a* of the retainer 17, and an inclined portion 17*e* for receiving a jig for canceling the regular engagement is provided in an outer side of a front end of the rectangular projection 17*d*.

Further, on the upper surface of the base plate 17*a*, there is provided a regular engagement projection 17*f* for mainly engaging the retainer 17 with the inner housing 12 when moving the retainer 17 from the temporary engagement position to the regular engagement position within the inner housing 12.

Figure 4A:
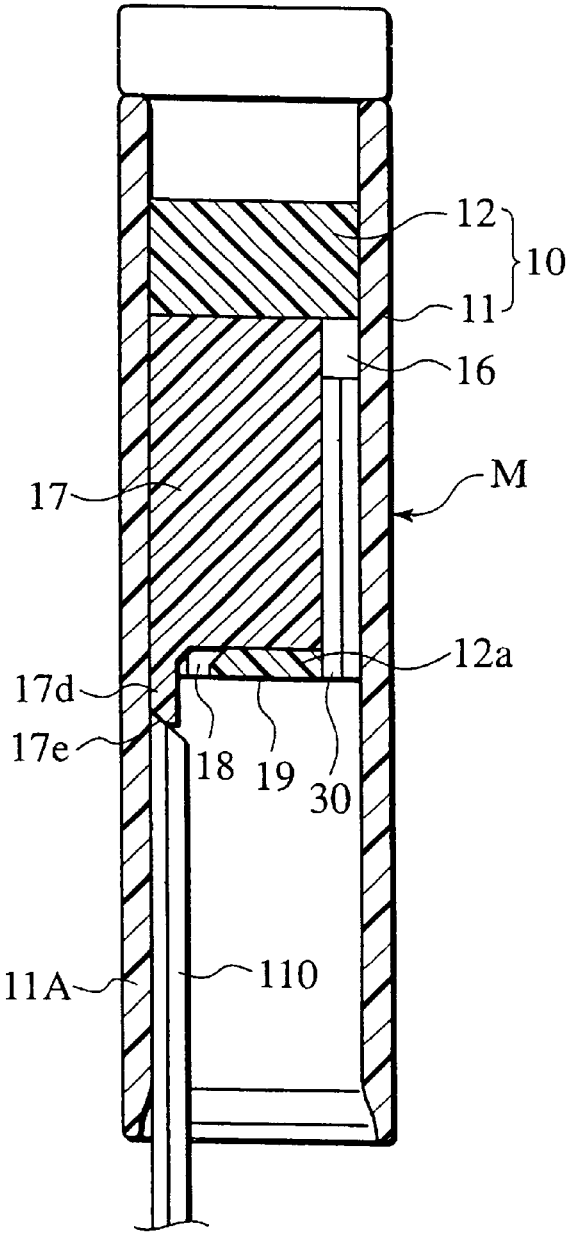
FIG. 4A is a schematic view of the connector according to the embodiment, showing a state that the retainer is in a regular engagement position.
Figure 4B:
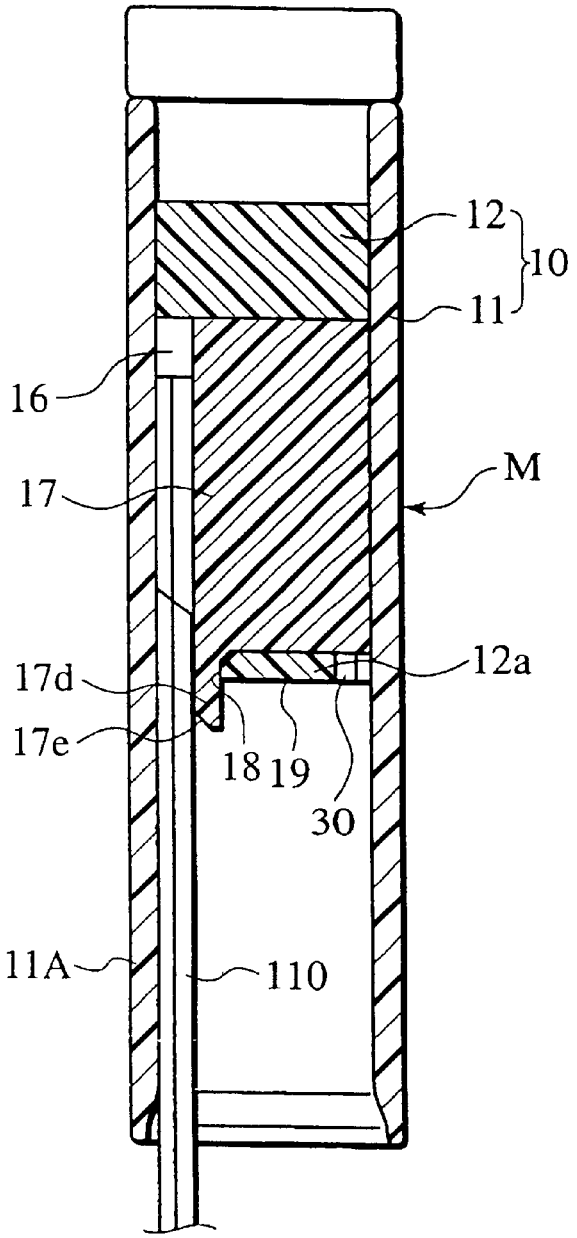
FIG. 4B is a schematic view of the connector according to the embodiment, showing a state that the retainer is in a temporary engagement position.

The projection 17*d* provided on the front end of the retainer 17 protrudes from a window 18 provided on the front end wall 12*a* of the inner housing 12, as shown in FIGS. 4A and 4B. In this case, the front surface of the front end wall 12*a* of the inner housing 12 corresponds to an abutment surface 19 with which the front end surface of an opposing connector is brought into contact when fitting the connector to the opposing connector, and the projection 17*d* of the retainer 17 positioned to the rear of the abutment surface 19 protrudes forward from the abutment surface 19.

The retainer 17 is provided so as to move in a direction perpendicular to the inserting direction of the terminal metal fittings 20 between the regular engagement position shown in FIG. 4A and the temporary engagement position shown in FIG. 4B, and the size of the protruding window 18 of the projection 17*d* is secured to have a size by which the projection 17*d* can move according to a movement of the retainer 17.

Further, the retainer insertion hole 16 conceals inside the outer housing 11 by assembling the inner housing 12 provided with the retainer 17 in the outer housing 11.

Figure 5A:
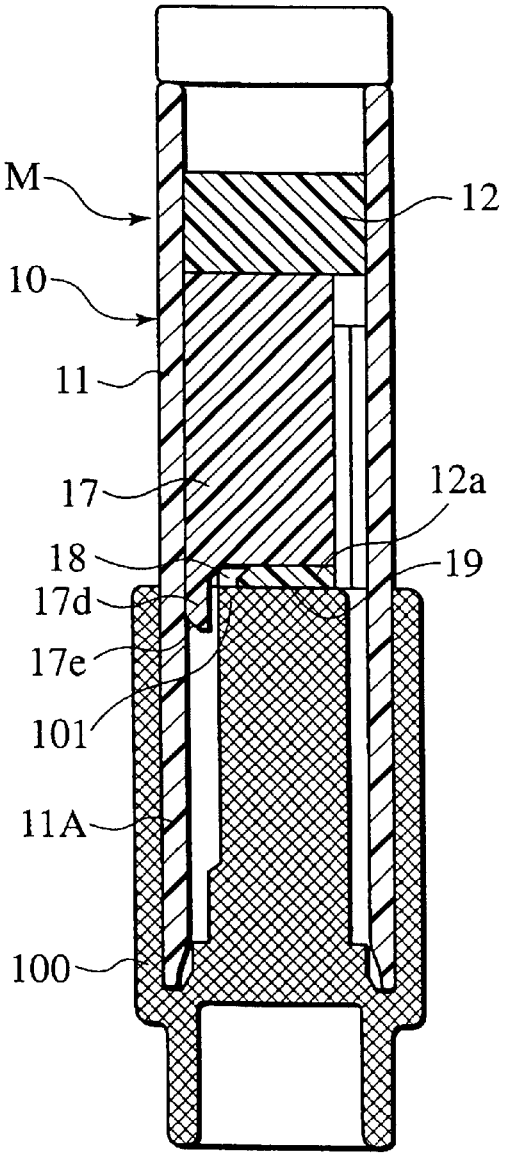
FIG. 5A is a schematic view showing a state that the connector according to the embodiment is fitted to an opposing connector, showing a state that the retainer is in a regular engagement position.
Figure 5B:
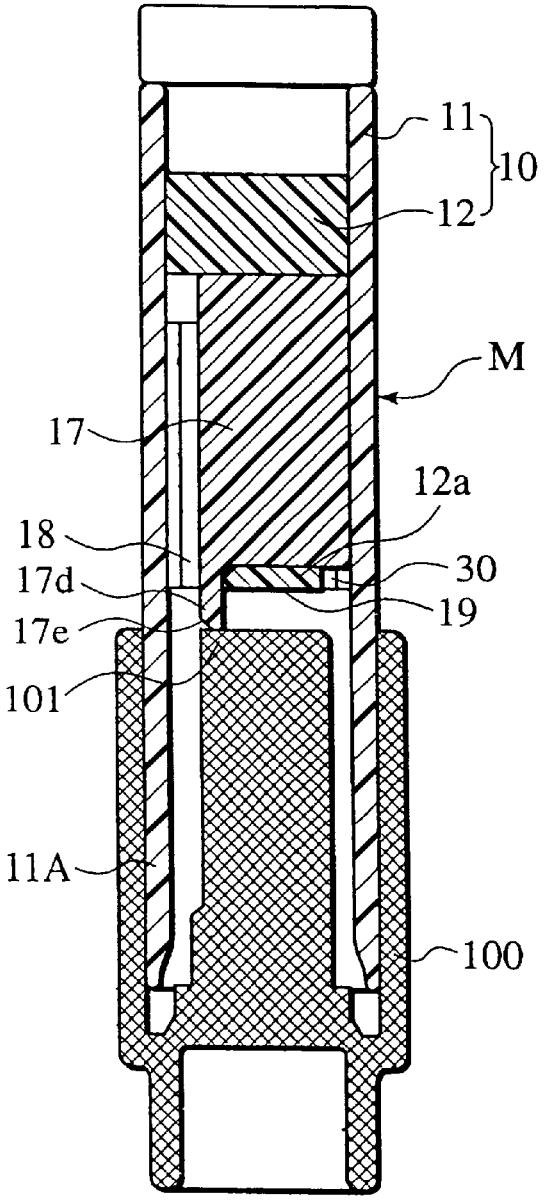
FIG. 5B is a schematic view showing a state that the connector according to the embodiment is fitted to an opposing connector, showing a state that the retainer is in a temporary engagement position.
Figure 6A:
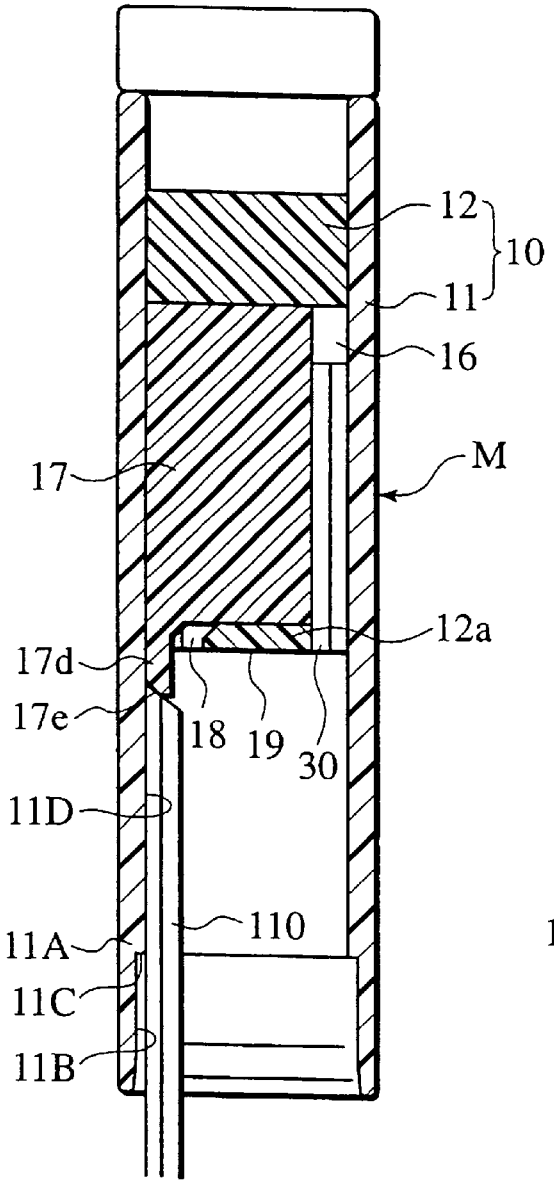
FIG. 6A is a plan cross sectional view of a modified first embodiment, showing a state that the retainer is in a regular engagement position.
Figure 6B:
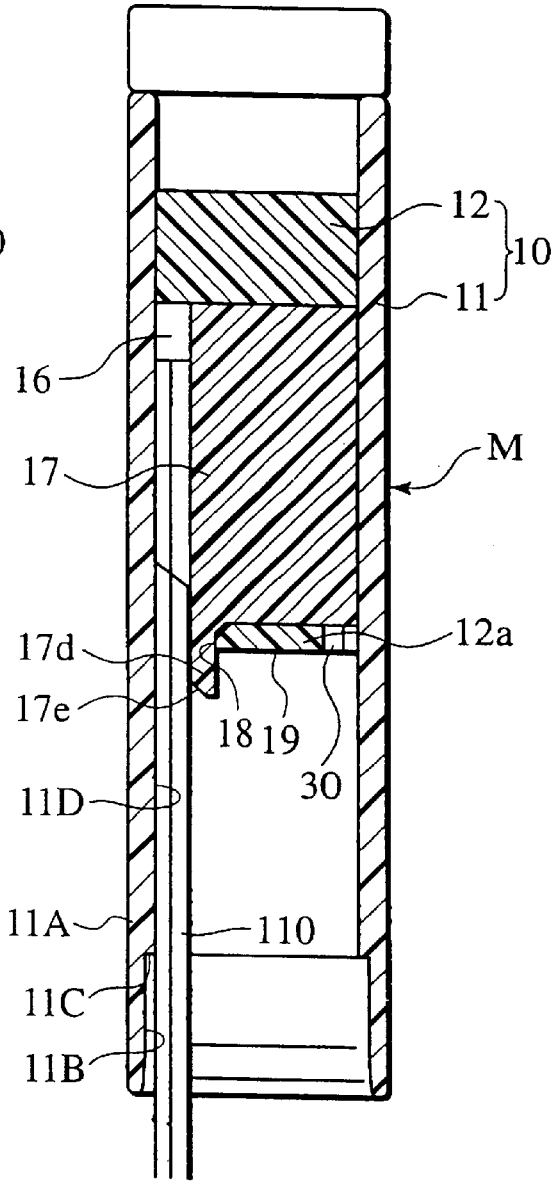
FIG. 6B is a plan cross sectional view of a modified first embodiment, showing a state that the retainer is in a temporary engagement position.
Figure 7A:
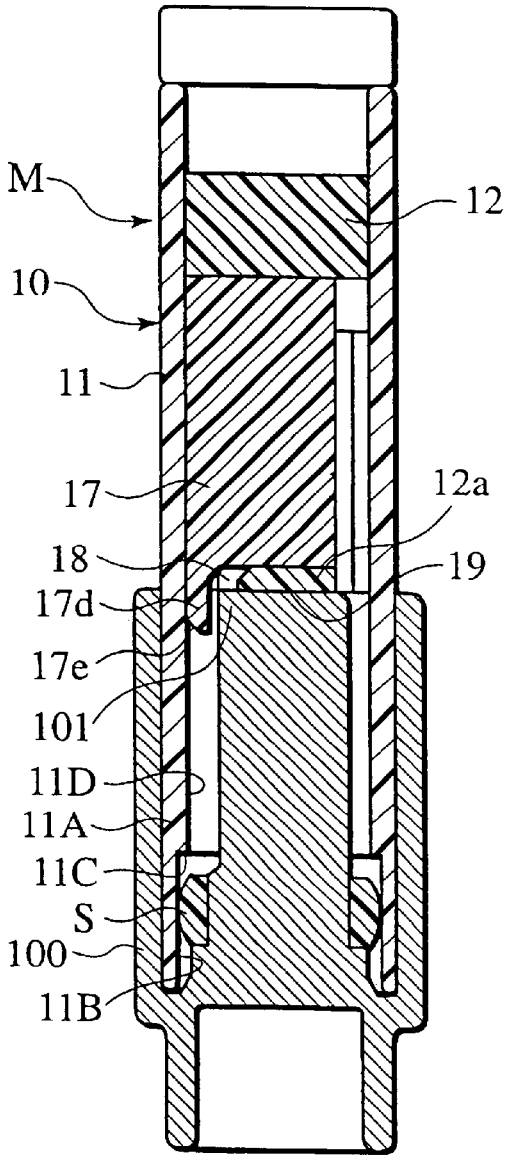
FIG. 7A is a plan cross sectional view of a modified first embodiment, showing a state that the retainer is in a regular engagement position.
Figure 7B:
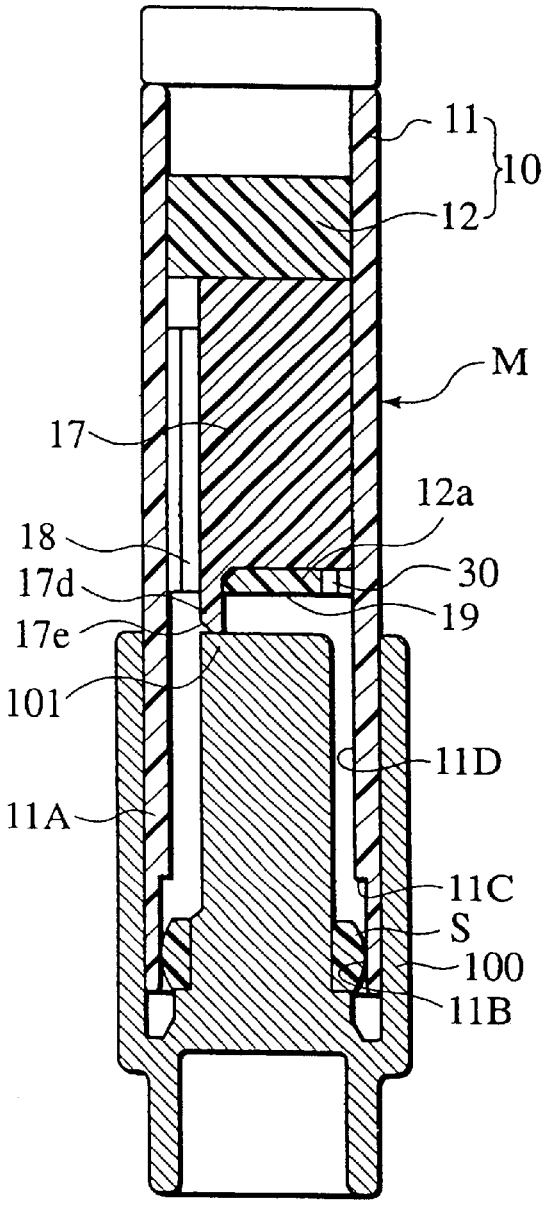
FIG. 7B is a plan cross sectional vies of a modified first embodiment, showing a state that the retainer is in a temporary engagement position.

Further, as shown in FIG. 5, in a side of an opposing connector 100 fitting to this connector M, there is provided a portion 101 interfering with the projection 17*d* only when the retainer 17 is at the temporary engagement position shown in FIG. 5B. Accordingly, the structure is made such that when the retainer 17 is at the temporary engagement position shown in FIG. 5B, the projection 17*d* is interfered with the opposing connector 100 to be fitted so as to prevent the opposing connector 100 from being fitted to the normal position, and when the retainer 17 is at the regular engagement position shown in FIG. 5A, the projection 17*d* allows the opposing connector 100 to be fitted to the normal position.

Figure 2:
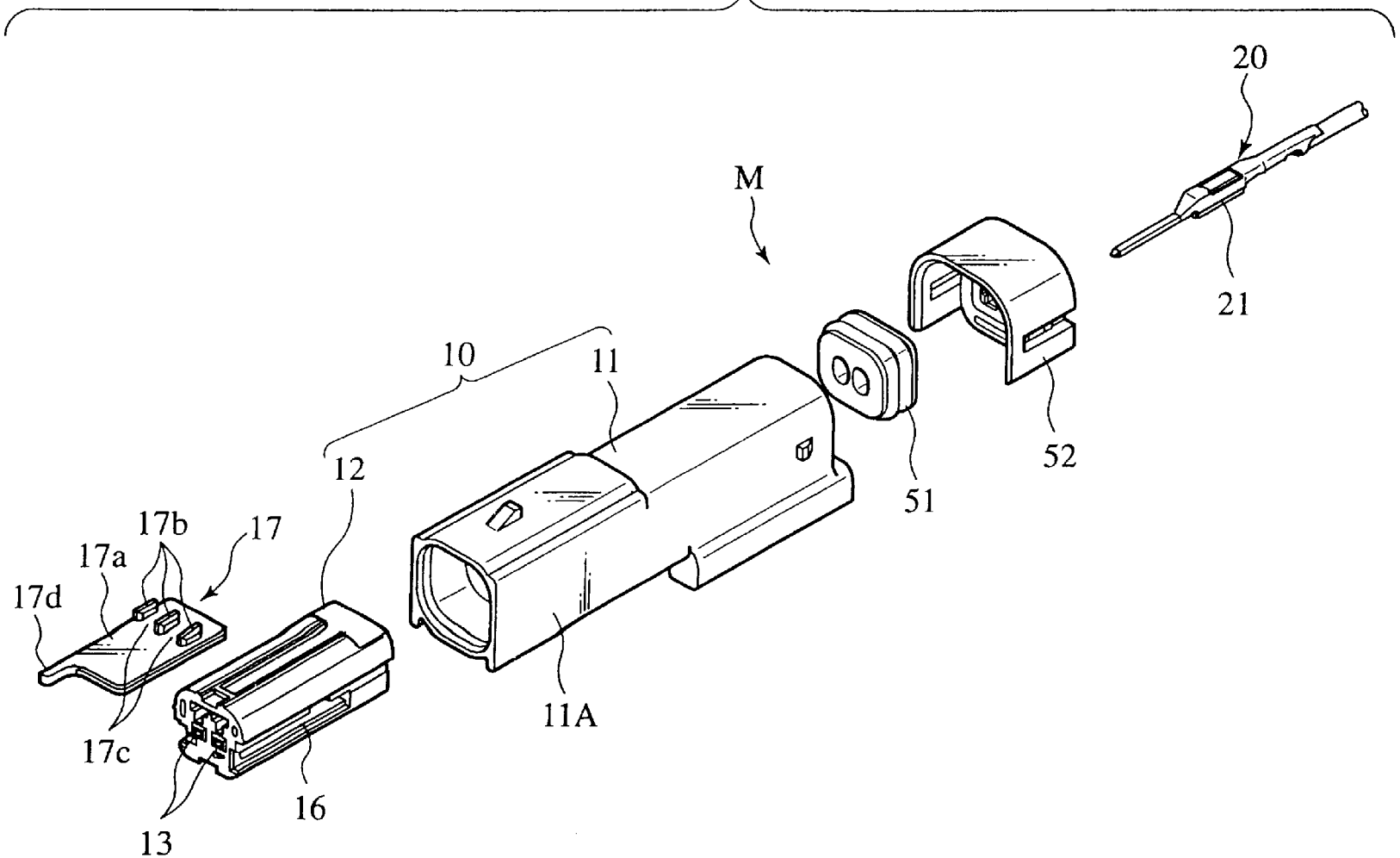
FIG. 2 is an exploded perspective view of the connector according to the embodiment.

In the case of assembling the connector M, at first, the retainer 17 is inserted to the retainer insertion hole 16 of the inner housing 12, and the inner housing 12 is inserted to the outer housing 11 and a seal member 51 and a rear holder 52 shown in FIG. 2 are attached additionally in a state of holding the retainer 17 at the temporary engagement position shown in FIG. 1A. Next, the terminal metal fittings 20 are inserted to the terminal insertion holes 13. Then, the terminal metal fittings 20 are primarily engaged with the lances 14 according to an inserting motion.

Next, the retainer 17 is moved in a direction opposite to the inserting direction of the terminal metal fittings 20 so that the retainer 17 is held at the regular engagement position. Accordingly, the engaging projections 17*b* of the retainer 17 are inserted to the space disposed at the back side of the box portion 21, whereby the terminal metal fittings 20 are secondarily engaged (doubly engaged) so as to be prevented from falling off rearward by the retainer 17.

In the assembled state mentioned above, in the case that it is desired to cancel the regularly engaged state of the retainer 17, a narrow rod-like jig 110 is inserted from the front end of the hood 11A and the projection 17*d* of the retainer 17 is hooked and moved by the front end of the jig 110 as shown in FIG. 4A. In particular, the jig 110 is inserted while being guided along the wall surface of the hood 11A, and the inclined portion of the front end of the jig 110 is further inserted while being pressed against the inclined portion 17*e* of the projection 17*d*. Accordingly, a force in a lateral direction perpendicular to the inserting direction of the jig 110 is applied to the retainer 17 due to an operation of the inclined portion 17*e*, and the retainer 17 moves from the regular engagement position to the temporary engagement position, as shown in FIG. 4B. Accordingly, the fall-out prevention operation of the terminal metal fittings 20 by the retainer 17 can be cancelled, so that it is possible to remove optional terminal metal fittings 20 rearward by canceling the engagement of the lances 14.

Further, in the case of moving the retainer 17 positioned in the temporary engagement position to the regular engagement position while maintaining the state of the inner housing 12 in the outer housing 11, the projection 17*d* mentioned above may be moved by the jig 110, however, as shown in FIGS. 1A and 4B, the retainer 17 can be moved while utilizing the inclined surface at the front end of the jig 110 by inserting the jig 110 to a jig insertion hole 30 for a regular engagement formed on the abutment surface 19 of the inner housing 12.

As mentioned above, in this connector M, it is possible to cancel the regular engagement of the retainer 17 inserted in the inner portion of the connector housing 10 by moving the projection 17*d* by the front end of the jig 110 inserted to the inner portion of the hood 11A with keeping the state that the inner housing 12 is assembled in the outer housing 11. Further, since the projection 17*d* protrudes forward from the abutment surface 19 with respect to the opposing connector 100, the length of the jig 110 inserted from the hood 11A can be made small and a moving operability of the retainer 17 is improved.

Further, in the case of this connector M, since the retainer 17 can be operated in the temporary engagement position in the assembled state, the possibility is generated that the regular engagement is missed. However, since the projection 17*d* is at a position easily visible by viewing the inner portion of the hood 11A, it is possible to easily view whether the retainer 17 is at the temporary engagement position or at the regular engagement position, according to the position of the projection 17*d*. Accordingly, it is possible to prevent the terminal from falling off due to the regular engagement miss, and it is possible to secure a stable conductive performance.

Further, in the case of this connector M, as shown in FIG. 5B, when the retainer 17 is at the temporary engagement position, the opposing connector 100 is interfered with the projection 17*d* so as not to be fitted to the normal position, so that it is possible to securely detect the regular engagement miss of the retainer 17. In this case, since the fitting direction of the opposing connector 100 is opposite to the moving direction of the retainer 17, the retainer 17 erroneously moves to the regular engagement position from the temporary engagement position according to the fitting motion of the opposing connector 100, and it is possible to secure reliability of detecting the regular engagement miss.

Next, a description will be given of a modified first embodiment shown in FIGS. 6A, 6B, 7A and 7B. In this case, the same reference numerals are attached to the same elements as those of the embodiment mentioned above, and any overlapping description will be omitted.

As shown in FIGS. 6A, 6B, 7A and 7B, a seal surface 11B which a seal member S for sealing with respect to the opposing connector 100 is adhered to and brought into contact with, is provided in an opening side of an inner wall 11D of the hood 11A in such a manner as to be shifted from the inner wall surface 11D of the hood 11A. That is, the seal surface 11B is provided outside the inner wall surface 11D of the hood 11A, and a step 11C is provided between the seal surface 11B and the inner wall surface 11D of the hood 11A.

In this connector, since the front end portion of the jig inserted in the inner portion of the hood 11A is guided to the back of the hood 11A along the inner wall surface 11D of the hood 11A, the front end portion of the jig is not in contact with the seal surface 11B provided in such a manner as to be shifted from the inner wall surface 11D of the hood 11A, and it is possible to prevent the seal surface 11B from being broken. Accordingly, it is possible to prevent a seal performance performed by the seal members from being reduced and it is possible to obtain a stable waterproof performance.

Next, a description will be given of a second embodiment shown in FIG. 8, FIG. 9A and FIG. 9B. In this case, the same reference numerals are attached to the same elements as those of the embodiment mentioned above, and any overlapping description will be omitted.

Figure 8:
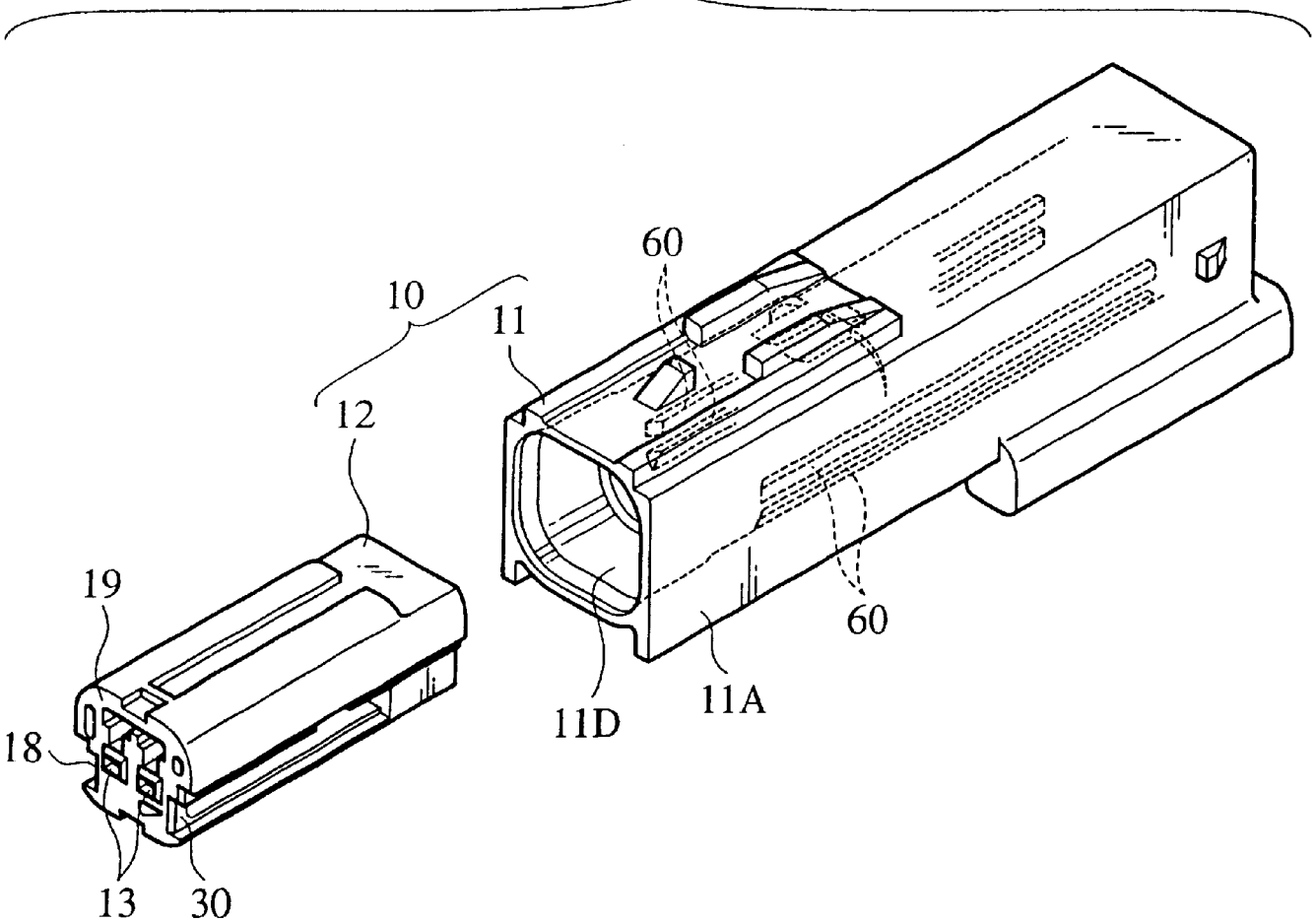
FIG. 8 is an exploded perspective view of a connector housing of a connector according to a second embodiment.
Figure 9B:
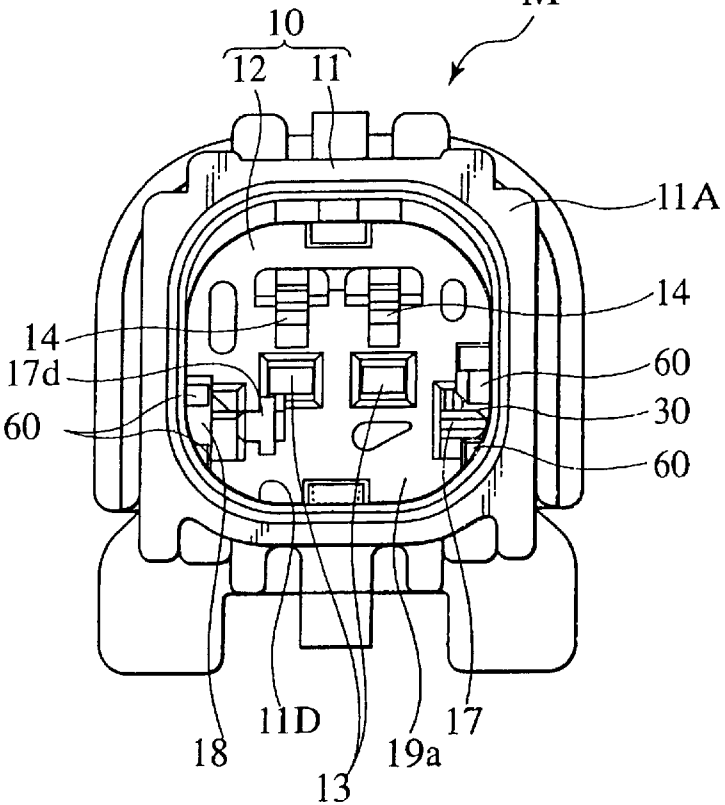
FIG. 9B is a front elevational view of the connector according to the embodiment.
Figure 9A:
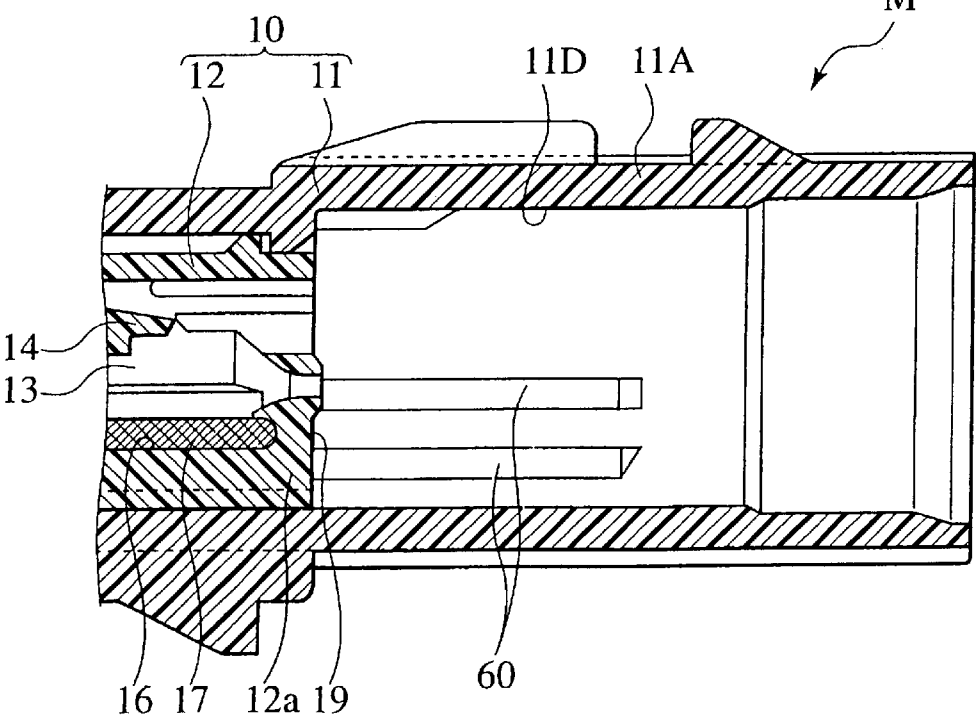
FIG. 9A is a plan view of the connector according to the embodiment.

As shown in FIG. 8, FIG. 9A and FIG. 9B, two guiding ribs 60 which guide a jig (not shown in the figs.) to move the retainer 17 protrude from an inner surface 11D of the hood 11A of the outer housing 11. Each guiding rib consists of a pair of rails running parallel along the direction of the jig insertion. One of the rib guides the jig to a position to move the retainer 17 projected from a window 18. The other rib guides the jig to a position to move the other end of the retainer 17 to the rear of jig insertion hole 30.

In this connector M, when the jig is inserted into the inside of the hood 11A of the outer housing 11, the jig is guided to the accurate position if the jig is inserted along the guiding rib 60. Thus, the operation of the retainer 17 is easy and time is saved. Additionally, damage to the connector M by the jig is prevented because the jig can be inserted to an accurate position.

A description will be given of a third embodiment shown in FIG. 10 and FIG. 11. In this case, the same reference numerals are attached to the same elements as those of the embodiment mentioned above, and any overlapping description will be omitted.

Figure 10:
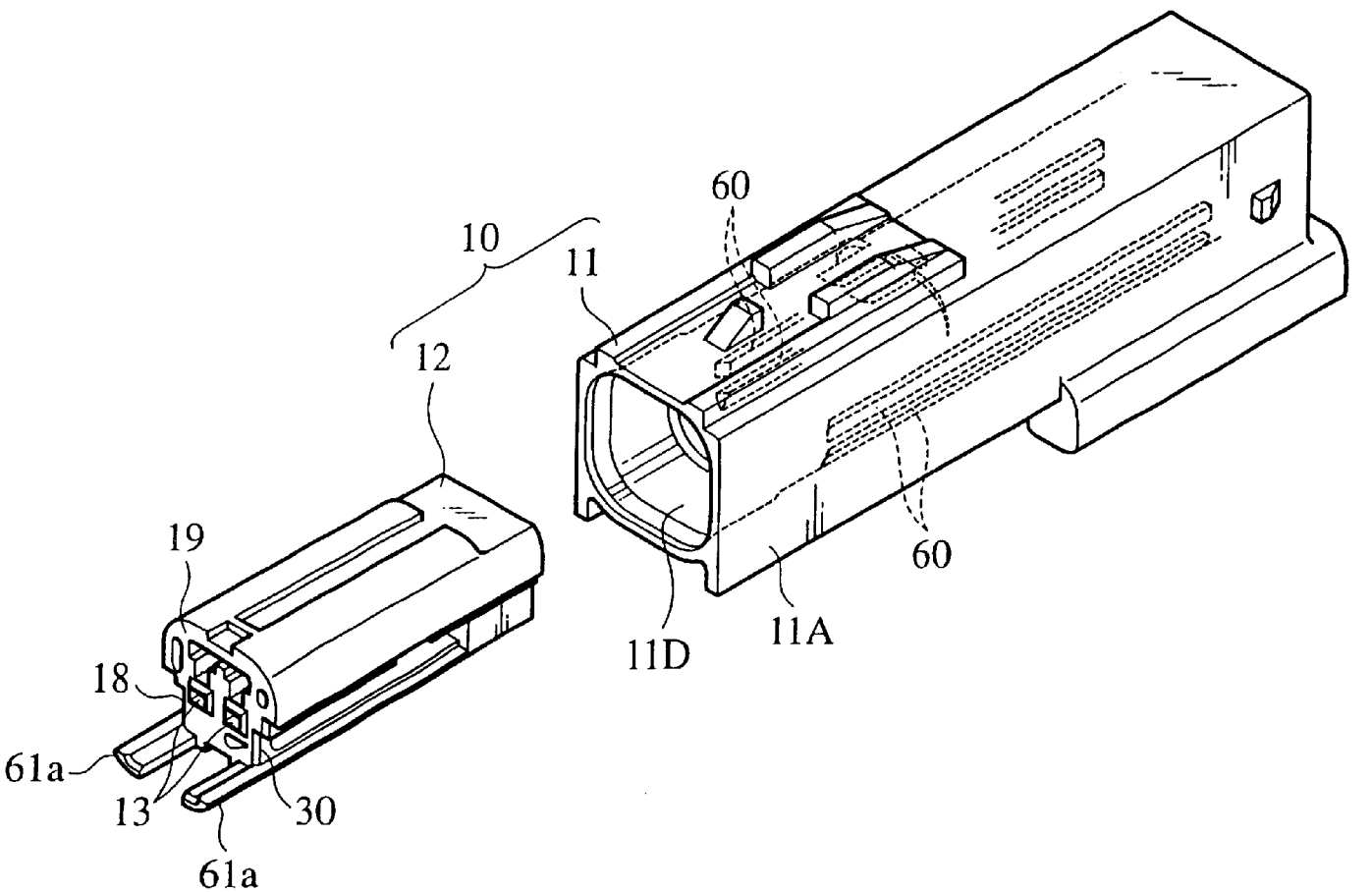
FIG. 10 is an exploded perspective view of a connector housing of the connector according to a third embodiment.
Figure 11B:
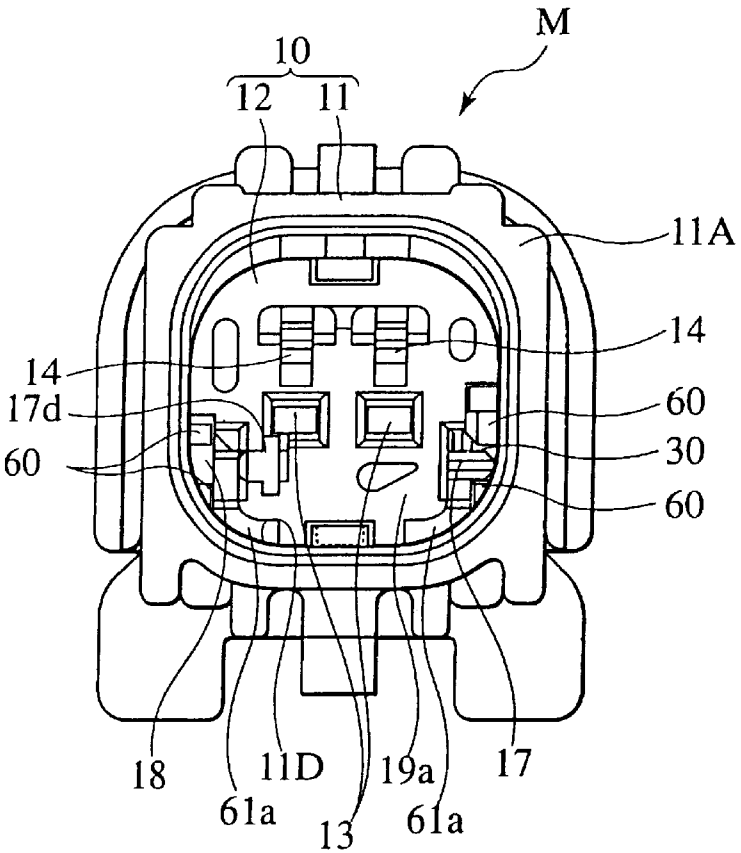
FIG. 11B is a plan view of the connector according to the embodiment.
Figure 11A:
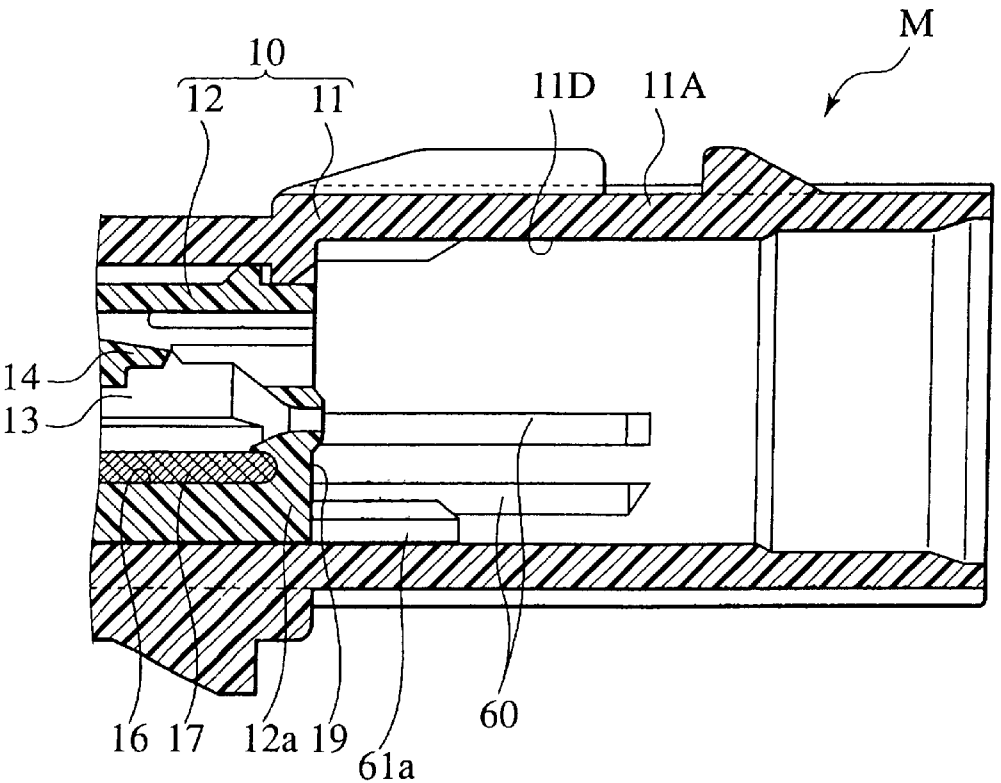
FIG. 11A is a cross sectional view of the connector according to the embodiment.

As shown in FIG. 10 and FIG. 11, side walls 61*a* project out of an abutment surface 19 of an inner housing 12 to an aperture of a hood 11A, and each side wall 61*a* is placed beside the one side of said each rib 60. An outer housing 11 including the guiding rib 60 is colored black, and the inner housing 12 including the side walls 61*a* is colored white to contrast with the color of said outer housing 11.

In this connector M, when the jig is inserted into the inside of the hood 11A of the outer housing 11, the jig is guided to an accurate position if the jig is inserted along the guiding rib 60, as in the case of the second embodiment mentioned above. Furthermore, the jig can be inserted easily and accurately, so that the retainer can be operated easily because the guiding ribs 60 are easily distinguishable from the other portion of the outer housing 11 due to the contrast between the color of the guiding ribs 60 and the one of the side walls 61*a*.

A description will be given of a fourth embodiment shown in FIG. 12, FIG. 13A and FIG. 13B. In this case, the same reference numerals are attached to the same elements as those of the third embodiment mentioned above, and any overlapping description will be omitted.

Figure 12:
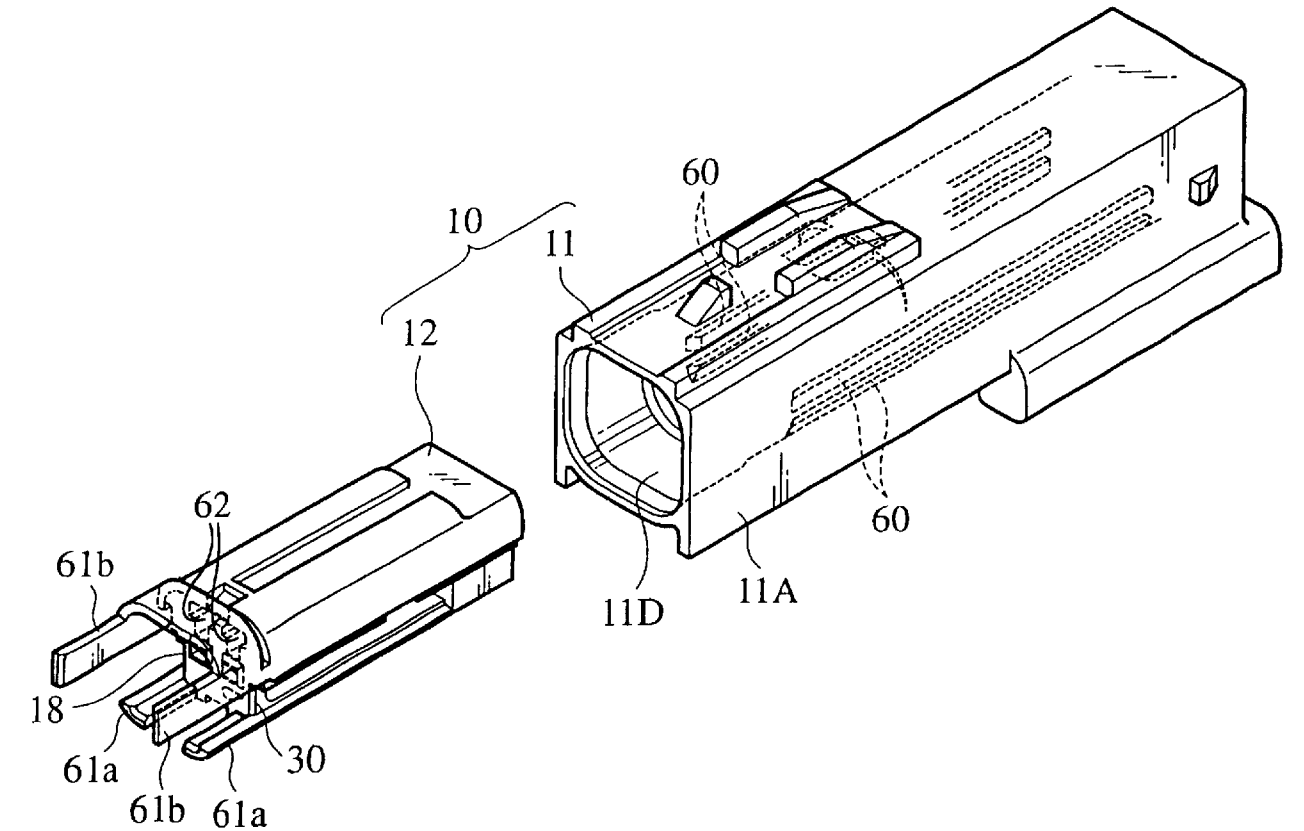
FIG. 12 is an exploded perspective view of a connector housing of a connector according to a fourth embodiment.
Figure 13B:
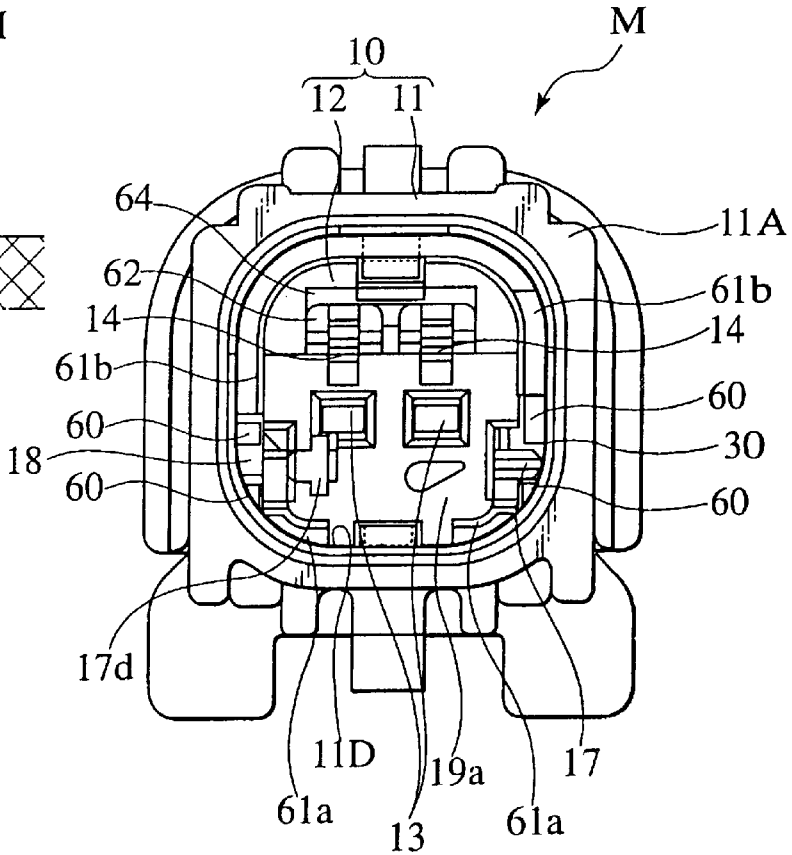
FIG. 13B is a front elevational view of a connector according to the embodiment.
Figure 13A:
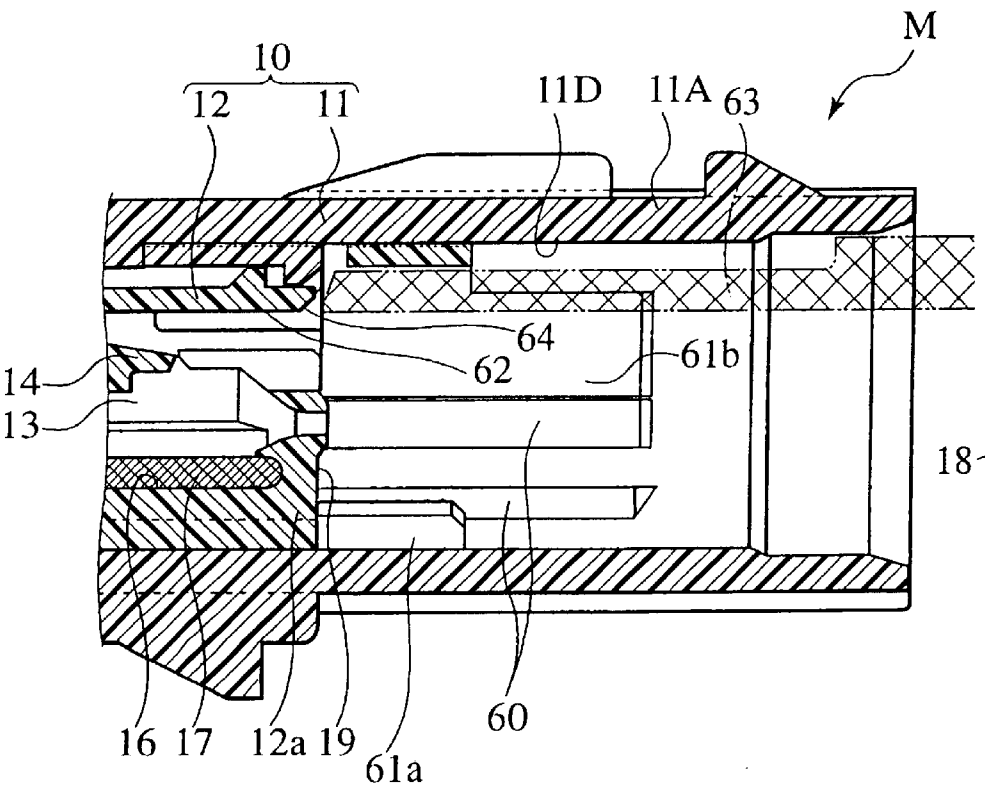
FIG. 13A is across sectional view of a connector according to the embodiment.

As shown in FIG. 12, FIG. 13A and FIG. 13B, side walls 61*a* and 61*b* are placed along either side of each guiding rib 60 in contrast with the case of the third embodiment mentioned above wherein each side wall 61 is place along one side of each guiding rib 60.

The flexible lances 14, primarily engaged with the inserted terminal metal fittings, and the insertion holes 62 are provided in inner housing 12 as mentioned in the description concerning the first embodiment. An abutment surface 19 comprises the apertures of the insertion holes 62 and inner walls of entrances of the holes have tapered surface 64 which guides a jig 63 used for canceling the engagement of the lance.

In this connector M, the side walls 61*a* and 61*b* are placed on either side of each guiding rib 60, so that the color of the guiding ribs 60 is contrasted more strikingly with the color or the side walls 61*a* and 61*b*. This leads to the easier operation of the retainer than the case of the third embodiment because the guiding ribs 60 are distinguished more easily.

Furthermore, in this connector M, the jig 63 can be inserted in the insertion hole 62 easily because, when the inserted jig 63 used for canceling the engagement of lance abuts the inner wall of the insertion hole 62, the jig 63 is guided by tapered surface 64 of the inner wall to be inserted in the insertion hole.

Figure 14:
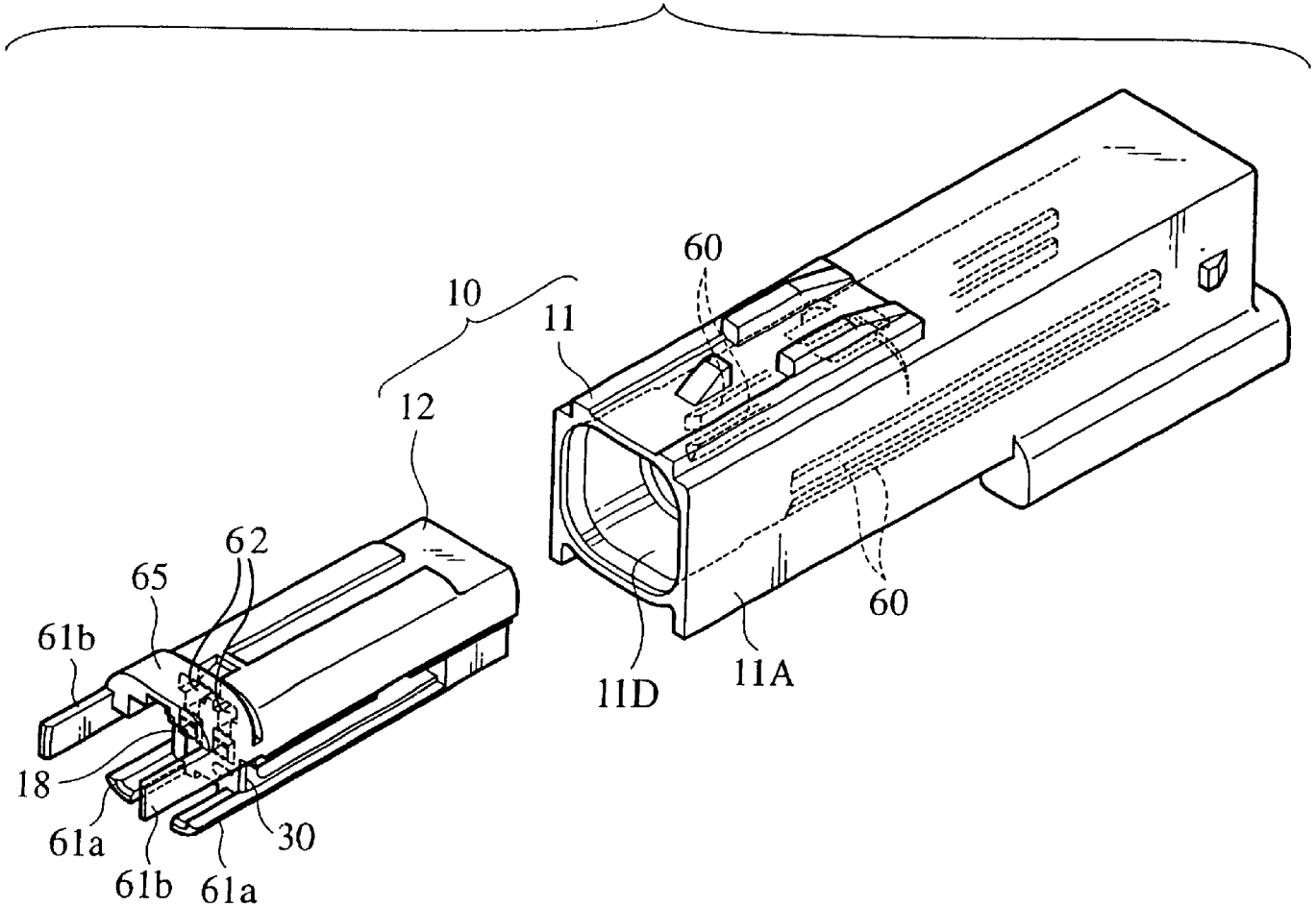
FIG. 14 is an exploded perspective view of a connector housing of a connector according to a fifth embodiment.
Figure 15B:
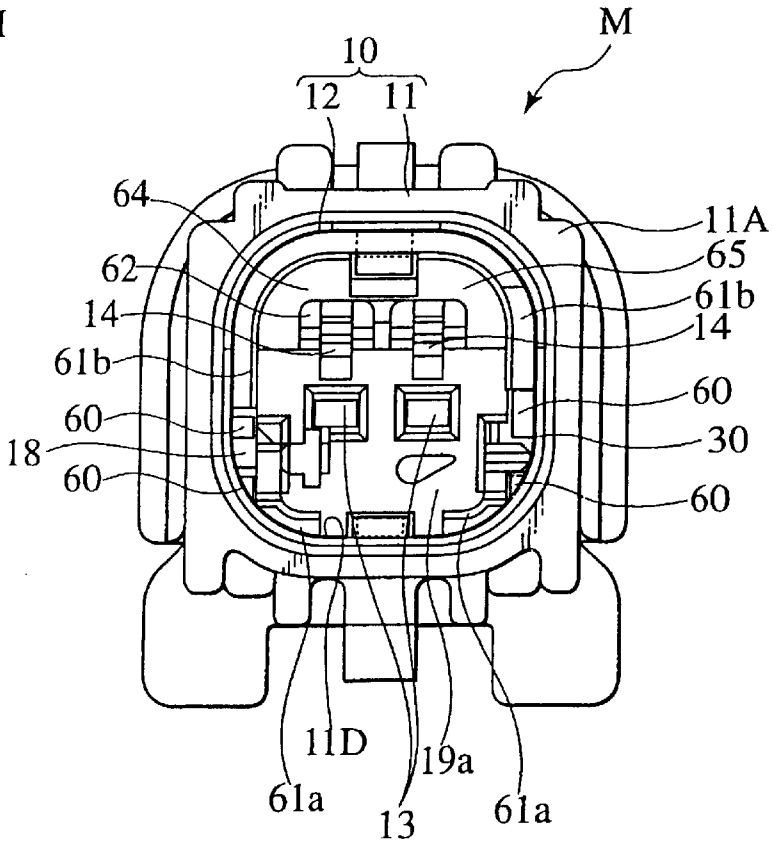
FIG. 15B is a front elevational view of a connector according to the embodiment.
Figure 15A:
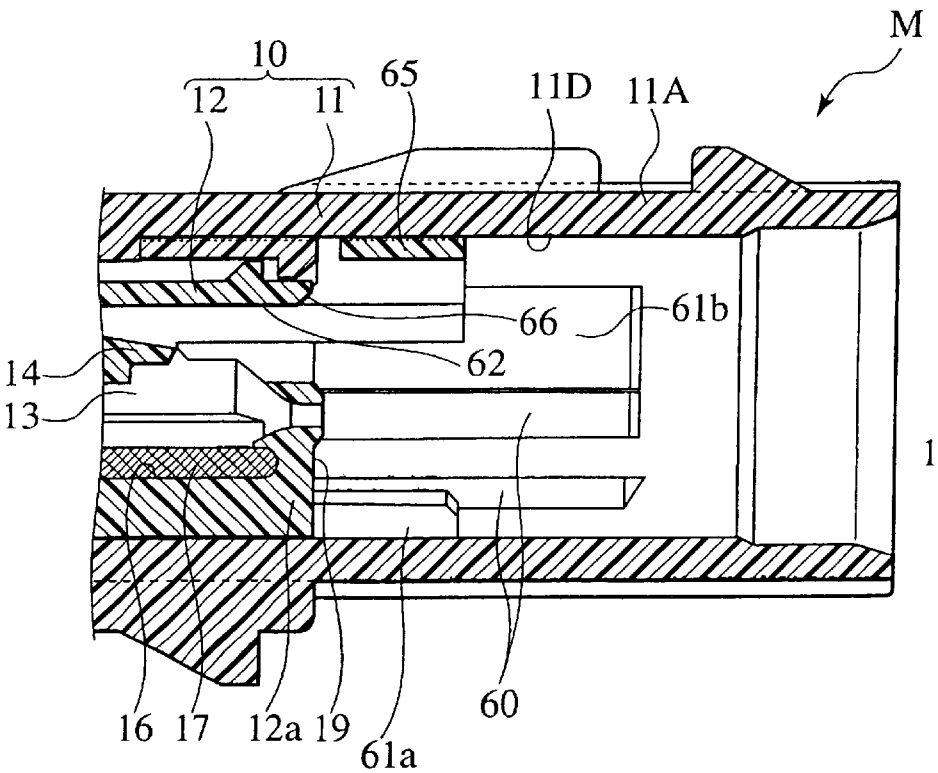
FIG. 15A is a cross sectional view of a connector according to the embodiment.

A description will be given of a fifth embodiment as shown in FIG. 14, FIG. 15A and FIG. 15B. In this case, the same reference numerals are attached to the same elements as those of the fourth embodiment mentioned above, and any overlapping description will be omitted.

As shown in FIG. 14, FIG. 15A and FIG. 15B, flexible lances 14, primarily engaged with the inserted terminal metal fittings (not shown in the figs.), and the insertion holes 62 are provided in the inner housing 12 as mentioned in the description concerning with the fourth embodiment. A protrusion 65 in which the insertion holes 62 are formed is projected from the abutment surface 19 forward to the aperture of hood 11A and the apertures of the insertion holes 62 are placed at the front surface of the side walls. A portion of the opposite connector corresponding to the protrusion 65 has notches so that the engagement of the connectors is not disturbed.

Furthermore, the aperture size of the insertion holes 62 provided in the protrusion 65 is formed larger than the size of inner portions of the holes so that inner walls of the holes are formed to be tapered surfaces 66 which guide the jig used for canceling the engagement of the lances.

In this connector M, the entrances of the insertion holes 62 are nearer to the aperture of the hood 11A of the outer housing 11 than the case of the embodiments mentioned above so that the jig used for canceling the engagement of the lances can be inserted easily and the operation is made easier. And, as the inner walls of the jig insertion holes 62 are formed to be a tapered surface but stepped surface, the jig used for canceling the engagement of the lances can be inserted smoothly.

Though the outer housing is colored black and the inner housing is colored white in the descriptions of the second to the fifth embodiments mentioned above, the combination of colors are not restricted as such. Any combinations of colors having contrast can be applied.

What is claimed is:

1. A connector for fitting an opposing connector having a front end surface, comprising:

a connector housing including a front end wall having an abutment surface, terminal insertion holes, and a hood, the abutment surface of the front end wall being configured to contact the front end surface of the opposing connector when the hood is fitted to the opposing connector;

terminal metal fittings inserted to the terminal insertion holes of the connector housing;

a retainer inserted to an inner portion of the connector housing at a rear position from the abutment surface and movable from a temporary engagement position to a regular engagement position so as to prevent the terminal metal fittings from falling out of the connector housing;

a projection provided in the retainer, the projection extending past the abutment surface of the front end wall toward the hood of the connector housing; and a jig insertion hole extending through the front end wall of the connector housing, the jig insertion hole being provided at a position such that a jig being inserted through the jig insertion hole moves the retainer from the temporary engagement position to the regular engagement position.

2. A connector according to claim 1, wherein the connector housing includes an outer housing and an inner housing inserted in an inner portion of the outer housing, the retainer is inserted in a retainer insertion hole formed in the inner housing, and the retainer insertion hole is hidden inside the outer housing.

3. A connector according to claim 1, wherein the retainer is a side spacer inserted in the connector housing from a direction crossing an inserting direction of the terminal metal fittings, and the side spacer is provided with opening portions allowing the terminal metal fittings to pass therethrough when the side spacer is at the temporary engagement position and engaging wall portions preventing the terminal metal fittings from falling rearwardly out of the connector housing when the side spacer is at the regular engagement position.

4. A connector according to claim 1, wherein the projection is at a position to interfere with the opposing connector to prevent the front end surface of the opposing connector from contacting the abutment surface of the connector housing when the retainer is at the temporary engagement position, and the projection is at a position to allow the front end surface of the opposing connector to contact the abutment surface of the connector housing when the retainer is at the regular engagement position.

5. A connector according to claim 1, wherein the hood of the connector housing includes an inner surface, a seal surface shifted outwardly from the inner wall surface, and a step portion provided between the inner surface and the seal surface.

6. A connector according to claim 1, wherein said connector housing further comprises:

lances engaged with said terminal metal fittings; and insertion holes having tapered inner walls into which a jig is inserted to disengage the lances from said terminal metal fittings.

7. A connector according to claim 1, wherein said connector housing further comprises:

lances engaged with said terminal metal fittings;

a protrusion projecting from said abutment surface toward the hood; and insertion holes provided in said protrusion into which a jig is inserted to disengage the lances from said terminal metal fittings.

8. A connector according to claim 3, wherein the side spacer includes a base plate having an upper surface, the engaging wall portions protrude upwardly from the upper surface of the base plate, and the opening portions are formed between the engaging wall portions.

9. A connector according to claim 1, wherein said connector housing further comprises guiding ribs provided on inner walls of the connector housing to guide jigs used for moving said retainer between the temporary engagement position and the regular engagement position, one of the guiding ribs being aligned with the jig insertion hole.

10. A connector according to claim 9, wherein said connector housing further comprises side walls projection from the abutment surface toward the hood on either side of said ribs, and said side walls and said guiding ribs have contrasting colors.

* * * * *